United States Patent [19]

Meyers

[11] Patent Number: 4,724,646

[45] Date of Patent: Feb. 16, 1988

[54] VARIABLE PITCH ROOF SUPPORT ASSEMBLY AND COMPONENTS THEREOF

[75] Inventor: Leo J. Meyers, Penn Hills, Pa.

[73] Assignee: Sun Room Designs, Inc., Youngwood, Pa.

[21] Appl. No.: 909,844

[22] Filed: Sep. 19, 1986

[51] Int. Cl.[4] ..... E04B 7/16; A01G 9/00

[52] U.S. Cl. ..... 52/66; 47/17; 52/90; 52/98

[58] Field of Search ..... 52/90, 64, 66, 71, 80, 52/82, 86, 98; 47/17

[56] References Cited

U.S. PATENT DOCUMENTS

| | | | |
|---|---|---|---|
| 3,158,961 | 12/1964 | Hawkins | 52/71 |
| 3,436,881 | 4/1969 | Schlecht | 52/90 |
| 3,771,277 | 11/1973 | Rausch et al. | 52/90 X |
| 4,205,496 | 6/1980 | Heirich | 52/90 X |
| 4,462,390 | 7/1984 | Holdridge et al. | 52/82 X |
| 4,596,093 | 6/1986 | Esposito | 47/17 X |
| 4,606,157 | 8/1986 | Esposito | 47/17 X |

FOREIGN PATENT DOCUMENTS

| | | | |
|---|---|---|---|
| 1343436 | 1/1974 | United Kingdom | 52/71 |

OTHER PUBLICATIONS

Sun Rooms Solar Rooms Greenhouses, Sun Room Designs Incorporation, "Let the Sunshine In".

*Primary Examiner*—J. Karl Bell

*Attorney, Agent, or Firm*—Arnold B. Silverman; Richard V. Westerhoff

[57] ABSTRACT

An assembly for securing roof panels at selectable pitch angles includes an extruded ridge bar having a horizontal ledge and a horizontally extending arcuate flange which form a horizontal slot in which the roof panels are supported at the desired pitch. Horizontally extending end portions of the arcuate flange are removable to set the angle of the slot for the desired pitch. Roof support bars extending along the side edges of the roof panels are connected to the ridge bar at the selected pitch by hinge assemblies having their pivot axes coincident with the center of curvature of the arcuate flange. A header supporting the panels at the eave comprises two extruded channel members pivotally connecting one flange of each channel member. A bifurcated arcuate end portion of the other flange on one channel member straddles the arcuate end portion of the other flange on the other channel member as the channel members are rotated to set the selected roof pitch. A pivot bracket joining the roof support bars to vertical support bars includes pivot bars connected to the support bars and rotatably connected by a pivot pin extending through transverse bores in mating bosses. Set screws or roll pins secured in holes drilled in each boss in alignment with a groove in the other boss, engage the groove to fix the support bars at the selected pitch.

26 Claims, 9 Drawing Figures

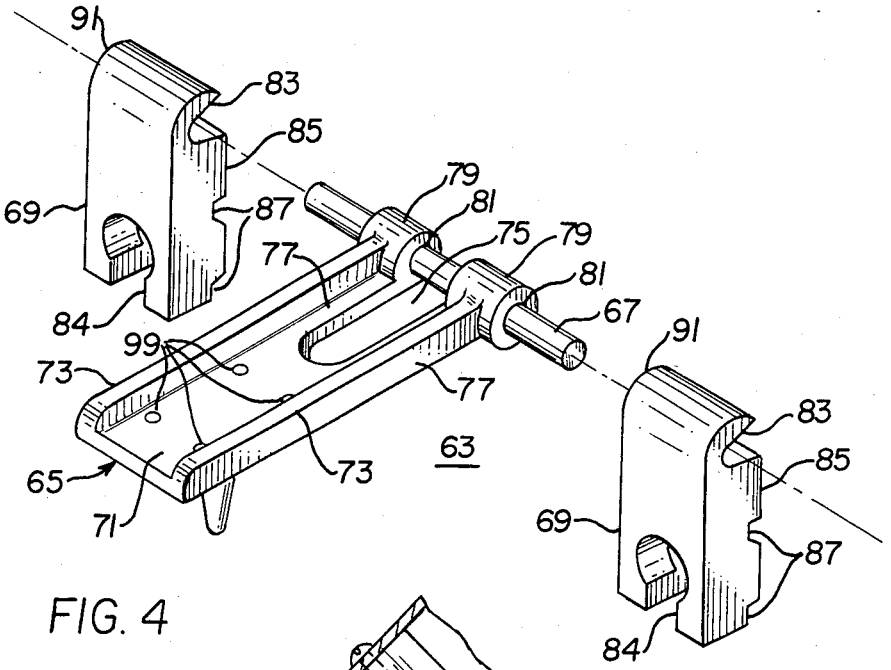
FIG. 4
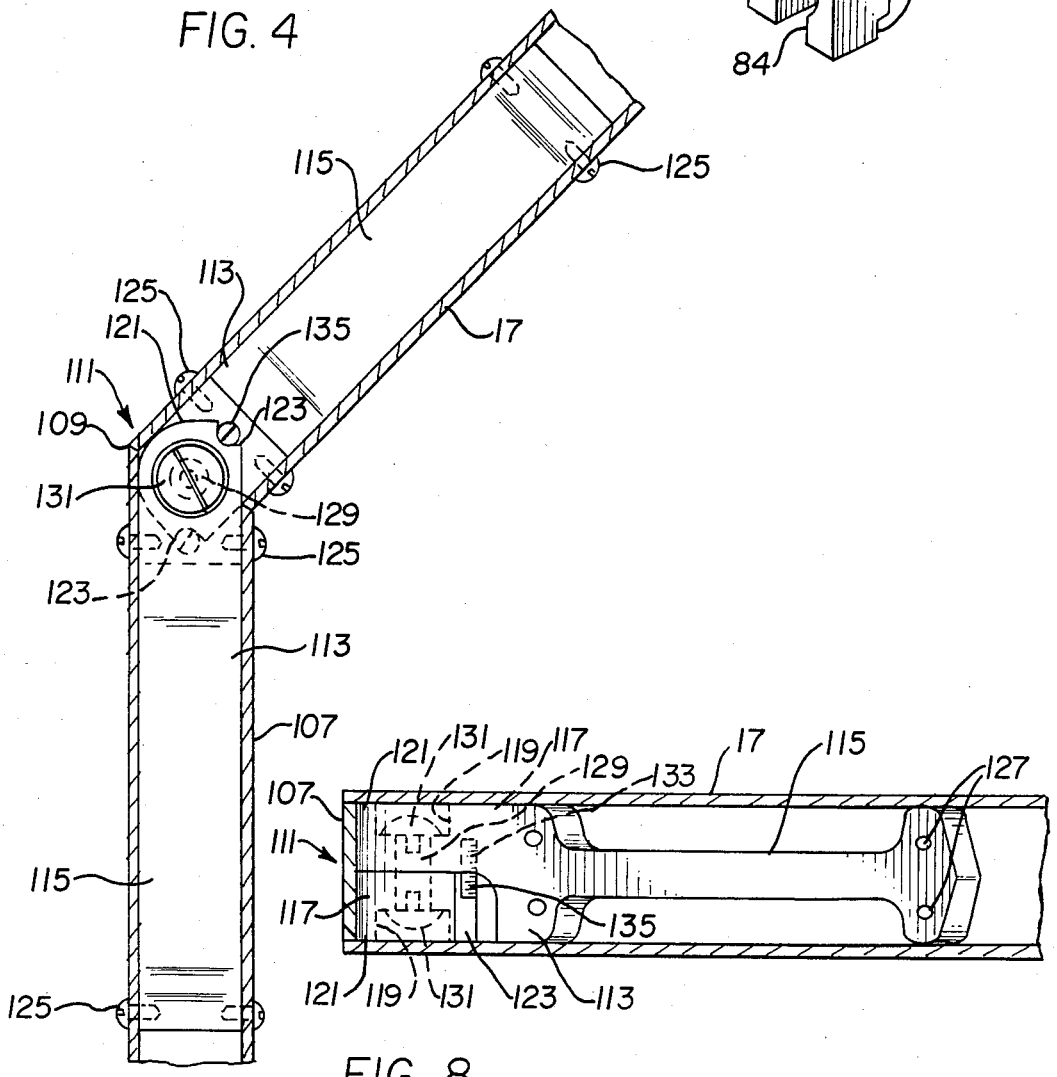
FIG. 8
FIG. 7

VARIABLE PITCH ROOF SUPPORT ASSEMBLY AND COMPONENTS THEREOF

BACKGROUND

1. Field of the Invention

This invention relates to an assembly for supporting roof panels at selected pitch angles and standardized components thereof which can be adjusted to provide the selected roof pitch.

2. Background Information

In adding lean-to type structures to existing or new construction, the pitch of the roof of such an addition is often dictated by details of the main structure and conditions at the site. This makes it difficult to construct such lean-tos from standardized components.

Typically, the roof of a lean-to addition is connected to the main structure by a ridge bar which supports the roof at the required pitch angle. A popular type of lean-to addition is the sun room in which the roof, as well as the walls, are constructed of glass panels. In many of these installations, a header is provided along the eave where the wall panels join the roof panels. This header also must accommodate the pitch of the roof panels. Furthermore, support bars which support the side edges of the glass panels in the roof must be supported at the ridge and the eave at the same pitch angle as the panels.

At the present time, the available ridge bars, headers, and supports for the roof support bars are designed for only one roof pitch. Thus it is necessary to manufacture and maintain an inventory of ridge bars, headers, and support bar supports for several different roof pitches. This is clearly expensive and inconvenient. Furthermore, it is only practical to maintain an inventory of components for a few standardized roof pitches.

It is a primary object of the present invention to provide an assembly for supporting roof panels at selected roof pitch angles.

It is another important object of the invention to provide such an assembly which is constructed from standardized adjustable components.

It is a more specific object of the invention to provide a ridge unit for such an assembly which secures both the roof panels and panel support members at the selected pitch.

It is another specific object of the invention to provide a header unit which joins the roof panel to wall panels at the eaves at the selected pitch.

It is still another object of the invention to provide such a ridge bar and header unit which are extruded.

It is yet another specific object of the invention to provide a pivot bracket for joining the roof support members to vertical supports at the selected pitch, and for rigidly fixing the supports at the selected angle.

SUMMARY OF THE INVENTION

These and other objects are realized by an assembly which includes a ridge unit for securing roof panels at the ridge at selectable pitch angles, and for securing roof support bars at the same selected pitch angle. The invention further includes an adjustable header for securing the roof panels at the selected pitch angle at the eaves, and a pivot bracket for securing the roof support bars to vertical support bars at the eaves at the same pitch angle.

The ridge unit includes an elongated ridge bar, preferably extruded from aluminum, having a generally longitudinally extending ledge projecting laterally from a generally planar base and a generally longitudinally extending arcuate flange which projects laterally from the base and curves toward the ledge to form a longitudinal slot in which the glass panels are secured. End portions of the arcuate flange are removable, such as by bending along score lines, to adjust the angle of the elongated slot and therefore the pitch of the roof panels. The roof support bars are secured to the ridge bar by a hinge assembly which has its hinge point coincident with the center of curvature of the arcuate flange so that the support bar can easily be rotated to the plane of the roof panels.

The adjustable header at the eaves comprises two generally U-shaped channel members pivotally connected along one flange. Preferably, the one flange on one channel member terminates in a bead which defines a longitudinally extending cylindrical surface, while the one flange on the other channel member terminates in a rib which defines a groove with a cylindrical surface which mates with the cylindrical surface on the bead to form the pivoted connection between channel members. The other flanges on the channel members terminate in arcuate portions curved about the pivot axis of the first flanges. These arcuate portions of the other flanges remain in close overlapping relation with one another as one channel member is rotated relative to the other. Preferably, one of the arcuate portions is bifurcated to form an arcuate groove into which the arcuate portion of the other flange extends so that it is straddled by the bifurcated flange.

The pivot bracket, which adjustably joins the roof support bars and vertical support bars, includes a pair of pivot bars each of which is secured at one end to a support bar. A boss extending along one side from the other end of each pivot bar defines a transverse bore. A pivot pin extending through the bores pivotally connects the pivot bars and therefore the support bars so that the roof support bars can be rotated to any selected pitch. An elongated member is secured in a hole drilled in at least one boss so that it interferes with and prevents relative rotation of the support bars once the pitch has been set. Preferably, each boss defines a transverse groove which is engaged by a set screw into a tapped hole drilled in the other boss in alignment with the groove.

Other features and advantages of the invention will become evident from the following detailed description which follows.

BRIEF DESCRIPTION OF THE DRAWINGS

A full understanding of the invention can be gained from the following description when read in conjunction with the accompanying drawings in which:

FIG. 4 is an exploded isometric view of a hinge assembly in accordance with the invention used to secure the main roof support bars at the ridge bar at a selected roof pitch;

FIG. 7 is a side elevation view with parts cut away of an adjustable connection for securing the main roof support bars of the lean-to structure of FIG. 1 to the main vertical support bars at the selected roof pitch;

FIG. 8 is a plan view with parts cut away of the adjustable connection of FIG. 7.

DESCRIPTION OF THE PREFERRED EMBODIMENT

Figures 1, 2:
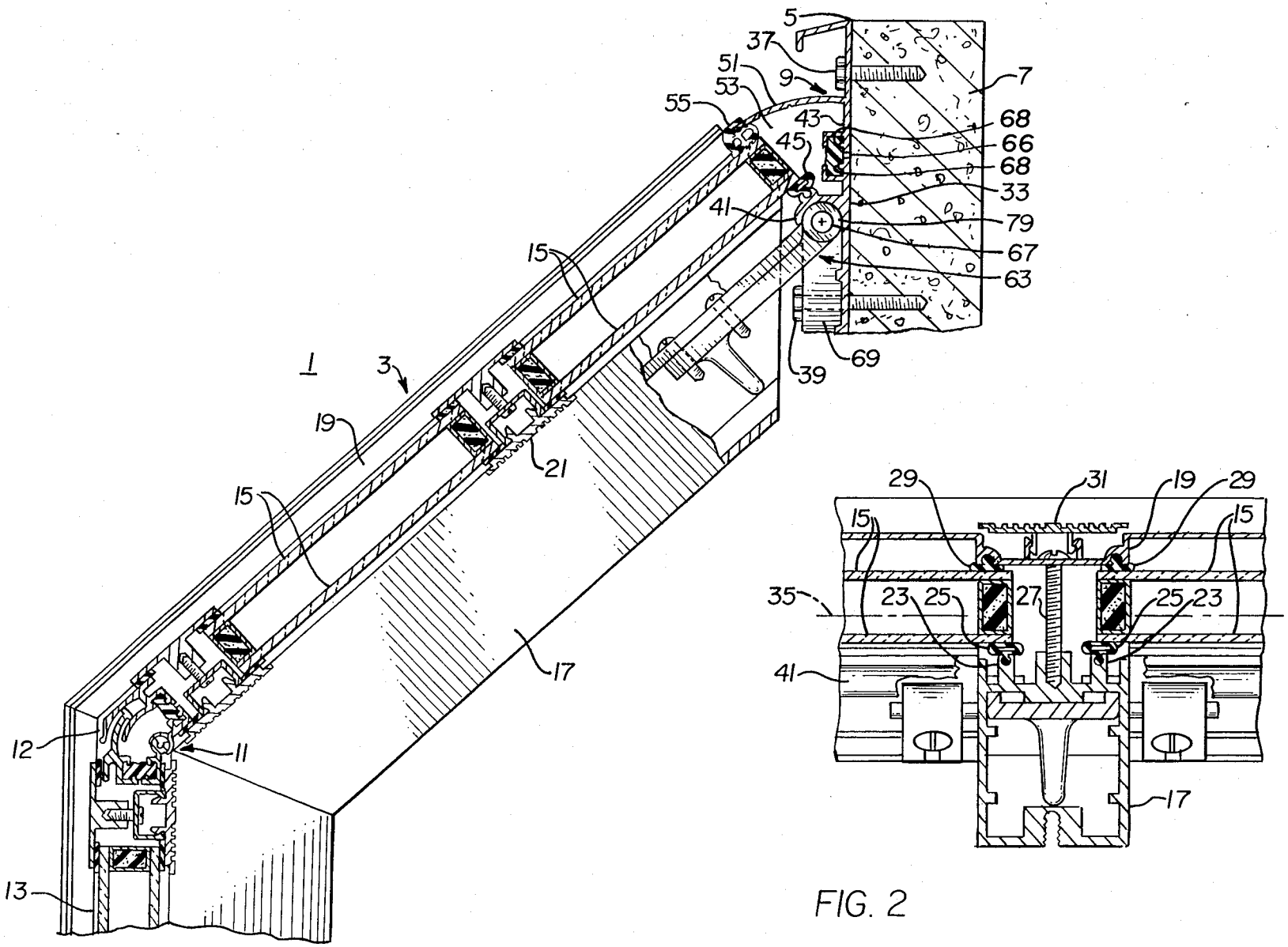
FIG. 1 is vertical transverse sectional view through a lean-to structure with a roof pitched at 45 degrees, to which the invention has been applied.
FIG. 2 is a longitudinal sectional view taken along the line 2—2 through the lean-to structure of FIG. 1.

FIG. 1 illustrates a lean-to structure 1 in accordance with the invention which includes a single pitch roof 3 secured at the ridge 5 to a vertical portion of a main structure 7 by a ridge bar 9. A header 11 along the eave 12 joins the roof 3 to a vertical wall 13 of the lean-to structure 1. As best seen in FIG. 2 the roof 3 includes panels 15 of double pane glass, main roof support or glazing bars 17 running from the ridge to the eave between the glass panels 15, sealing bars 19, and muntin assemblies 21 (See FIG. 1). The main roof support or glazing bars 17 are hollow, generally rectangular, preferably aluminum, extrusions which have upwardly projecting longitudinal ribs 23 upon which adjacent glass panels 15 are supported with thermal break material 25 inbetween. The glass panels are clamped in place by the sealing bar 19 which is secured to the main roof support bar 17 at spaced locations by screws 27. Sealing strips 29 make the connection water tight, and fluted cap strips 31 which snap into the sealing bar 19 conceal the screws 27 and provide a decorative finish.

Figure 3:
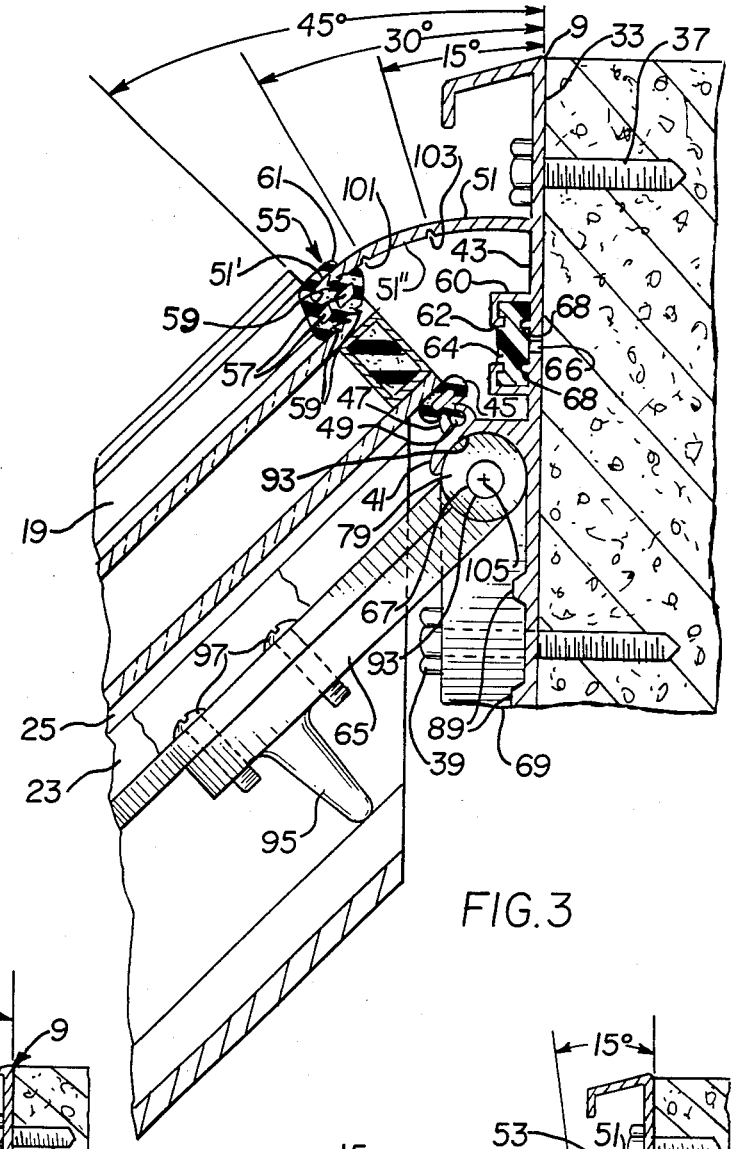
FIG. 3 is an enlarged view of the portion of the structure of FIG. 1 at the ridge.

As seen in FIG. 1, the muntin assemblies 21 seal the horizontal joints between glass panels 15. The ridge bar 9 which supports the ridge 5 of the roof 3 is, as seen in FIGS. 1 and 2, and in the enlargement of FIG. 3, an extrusion preferably of aluminum, having a generally planar base portion 33 which extends transversely to the longitudinal axis 35 of the extrusion. The base 33 is bolted to the vertical section of the main structure by bolts 37 and 39. A longitudinally extending ledge 41 projects laterally from one face 43 of the base portion 33 to form a lower support for the top edge of the glass panels 15. Preferably, a resilient strip 45 of insulating material, secured by an undercut tongue 47 which engages an undercut groove 49 in the ledge 41, provides a thermal barrier and a resilient seat for the glass panels 15.

A longitudinally extending arcuate flange 51 projects transversely from the one face of the base portion 33 a spaced distance above the ledge 41, and curves downward in a vertical plane transverse to the longitudinal axis 35 of the ridge bar 9. The arcuate flange 51 forms with the ledge 41 a longitudinally extending slot 53 in which the upper edges of the glass panels 15 are received. A sealing strip 55 extruded with two longitudinal passages 57, which provide resiliency and thermal barriers, is wedged into the slot 53 between the glass panels 15 and the arcuate flange 51 to lock the glass panel to the ridge bar 9. Molded fingers 15, and a longitudinal groove 61 which fits tightly over the arcuate flange 51 serve to secure the sealing strip in place.

A pair of longitudinal flanges 60 with confronting lips 62 extend horizontally from the base portion 33 between the ledge 41 and arcuate flange 51 to form an undercut groove for retaining thermal break material 64 which is applied in liquid form and allowed to harden in place. After the thermal break material 64 has hardened a longitudinally extending debridging slot 66 is milled along the length of the planar base portion 33 of the ridge bar 9 to create the thermal break. The thermal break material 64 is a resin having a low thermal conductivity which can be cast in place. A suitable thermal break material is BAYDUR 600. The debridged parts of the ridge bar 9 are connected by the hardened resin which is locked to the parts by the lips 62 and protrusions 68.

The main roof support bars or glazing bars 17 are secured to the ridge bar 9 by a hinge assembly 63 which includes a hinge member 65, a hinge pin 67, and a pair of hinge clips 69, all shown in FIG. 4. The hinge member 65 is preferably cast from aluminum with a generally planar body 71 with flanges 73 extending along the side edges of the top face. One end of the planar body 71 is bifurcated by a slot 75 to form parallel extensions 77 which terminate in transverse cylindrical bosses 79. A through bore 81 in each boss 79 receives the hinge pin 67 which is secured to the ridge bar 9 by the clips 69. The clips 69, also preferably cast from aluminum, have slots 83 opening toward the rear face 85 for receiving the hinge pin 67, and have counterbored, bolt receiving slots 84 which open from the lower edge of the clip. The clips 69 have horizontal grooves 87 extending across the rear face 85 which mate with longitudinal ribs 89 on the ridge bar 9 to aid in alignment (See FIGS. 1 and 3). The top edge of each clip 69 is provided with a radius 91 corresponding to the radii of the cylindrical bosses 79 on the hinge member 85.

The underside of the ledge 41 is provided with a longitudinal recess 93 which defines an internal cylindrical surface which receives the cylindrical bosses 79 on the hinge member 65 and the cylindrical end surfaces 91 of the clips 69. The arrangement is such that the center of curvature of the arcuate flange 51 is coincident with the axis of the hinge pin 67.

In order to secure a main roof support bar 17 to the ridge bar 9, the hinge member 65 is inserted into the end of the main support extrusion as shown in FIGS. 1 and 2. An integral tapered pin 95 projecting from the underside of the hinge number 65 provides support while four screws 97 are inserted through holes punched in the extrusion 17 and screwed into tapped bores 99 in the top surface of the hinge member 65. The hinge member 65 is then positioned with the bosses 79 in the cylindrical groove 93 in the bottom of the ledge 41 and the hinge pin 67 protruding from the bores 81 in the bosses 79. The clips 69 are then slipped over bolts 39 which have been loosened, but not removed, and with the ends of the hinge pin 67 captured in the slots 83, the bolts 39 are tightened to pivotally secure the roof support bar 17 to the ridge bar 9.

Figure 5:
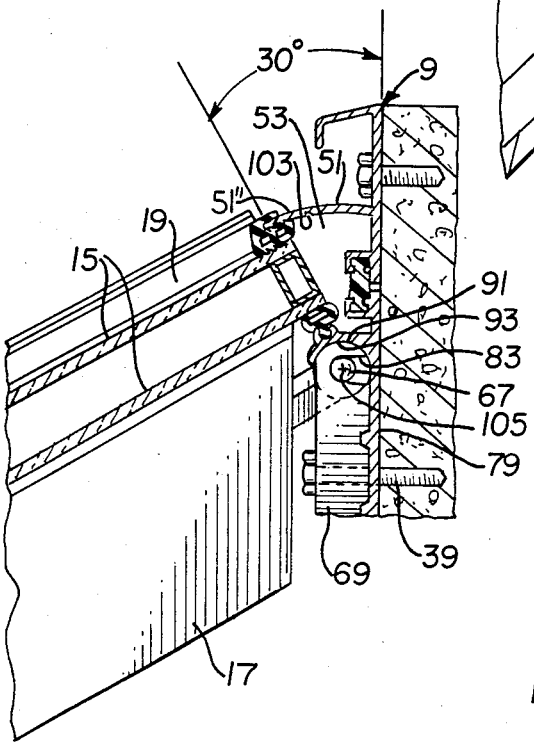
FIG. 5 and 6 are views illustrating adjustment of the structure at the ridge shown in FIG. 3 for roof pitches of 30 and 15 degrees respectively.
Figure 6:
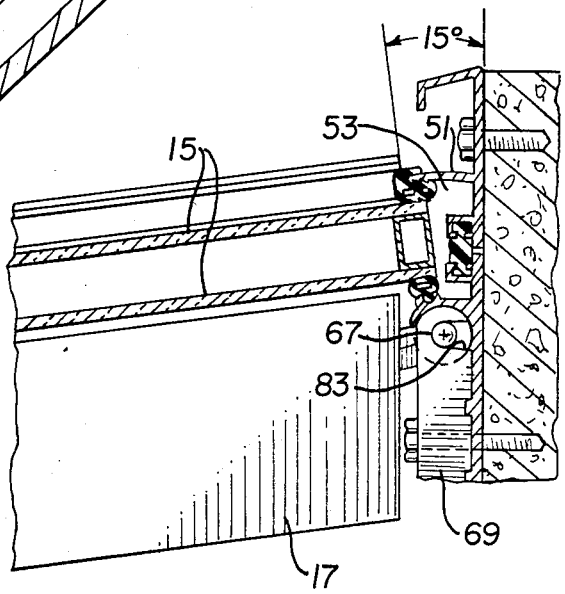
Figure 9:
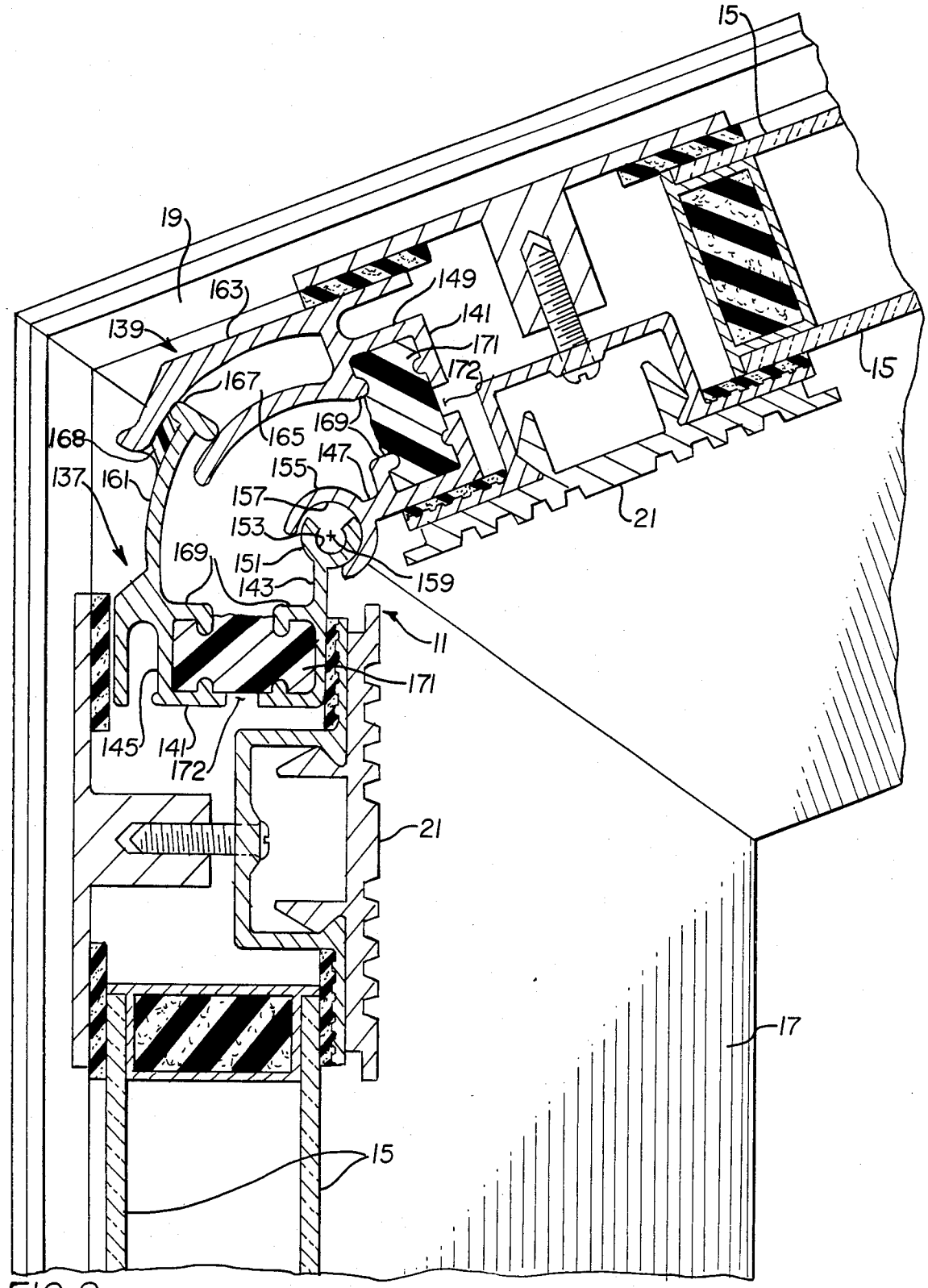
FIG. 9 is an enlarged vertical section through the structure FIG. 1 of at the eaves with the components adjusted for a roof pitch of 15 degrees.

The pitch angle of the roof 3 in the assembly shown in FIG. 1 is 45 degrees. In order to accommodate other pitch angles, the arcuate flange 51 is frangible along longitudinal score lines 101 and 103. Removing the section 51' at the score line 101 adjusts the opening of the slot 53 to receive the glass panels 15 at a 30 degree pitch angle as shown in FIG. 5. Similarly, removing also the section 51" to the score line 103 rotates the opening of the slot 53 to support the glass panels 15 at a pitch angle of 15 degrees as shown in FIG. 6. Of course, the length of the arcuate member 51 and the number and angles of the score lines 101, 103 can be varied to provide any desired range of selectable pitch angles. Since the main roof support bars 17 are pivotally mounted for rotation about an axis 105 coincident with the center of curvature of the arcuate flange, the pitch of the roof support bars 17 is easily adjusted to that set for the glass panels 15.

The main roof support bars 17 are supported at the eaves 11 by vertical support bars 107 of similar construction. A mitered joint 109 between the main roof support bar 17 and the main vertical support bar 107 is structurally supported by a pivot bracket 111 which is illustrated in side elevation in the cutaway view of the joint in FIG. 7, and in plan in the cutaway view in FIG. 8. The pivot bracket 111 is formed of two identical pivot bars 113 preferably cast from aluminum. These pivot bars 113 are sized to fit snugly at their ends into the extrusion forming the main roof support bar 17 and the main vertical support bar 107, but are of reduced cross section in the intermediate section 115. Extending along one side of one end of each pivot bar 113 is a boss 117 with a counterbored transverse bore 119. A radius 121 at one end edge of the boss is centered on the bore 119. The other corner edge of the boss 117 is rabbeted to form a transverse groove 123.

The pivot bars 113 are inserted into the respective support bars 17 and 107 and secured by screws 125 received in tapped bores 127. The bosses 117 are then pivotally connected by a pin 129 inserted in bore 119 and held in place by bolts 131. The main roof support bar 17 is then rotated relative to the main vertical support bar 107 to the selected pitch angle. A hole 133 is then bored and tapped in each boss 117 in alignment with the groove 123 in the other boss. Elongated members such as slotted set screws 135 screwed into these holes 133, interfere with the other boss to lock the pivot bracket 111 securely at the selected pitch angle. Alternatively, a roll pin may be press fit into an untapped bore 133 to provide the required interference.

The header 11 includes two pivotally connected channel members 137 and 139. These channel members, which preferably are extruded from aluminum, each have a central web 141 and a pair of longitudinally extending flanges 143, 145 and 147, 149, respectively, projecting laterally from the web 141. One flange 143 of the channel member 137 terminates in a bead 151 extending along the flange. The bead 151 is extruded with a groove 153 to reduce the material required in the extrusion, however, the bead 151 still defines at least a partial cylindrical surface. One flange 147 on the channel member 139 terminates in a rib 155 which defines a longitudinal groove 157 having a partial internal cylindrical surface. The cylindrical surface of the groove 157 mates with the cylindrical surface on the bead 151 for rotation relative thereto about the common longitudinal axis 159 to form a pivot connection between the two channel members 137 and 139. The other flange 145 on the channel member 137 terminates in an arcuate portion 161 which has as its center of curvature the common longitudinal axis 159. The other flange 149 on the channel member 139 terminates in a bifurcated arcuate portion 163 which defines an arcuate groove 165 also having as its center of curvature the common longitudinal axis 159. The bifurcated portion 163 of flange 149 straddles the arcuate portion 161 of flange 145 so that as the channel members 137 and 139 are rotated relative to one another the arcuate portion 161 slides within the arcuate groove 165 in overlapping relation with the bifurcated portion 163 of flange 145. A flange 167 on the end of arcuate portion 161 substantially spans the radial width of the arcuate gap 165 to form a pocket to receive a sealant or caulking compound 168 which effects an airtight and water tight seal. Confronting ribs 169 on the flanges 143, 145 and 147, 149 form recesses for retaining thermal barrier material 171. As in the case of the ridge bar, debridging slots 172 are milled along the entire length of the webs 141 to form a thermal break after the thermal break resin 171 has hardened in place. The channel members 137 and 139 are secured to the edges of the glass panels 15 forming the vertical wall 13 and roof 3 respectively by muntin assemblies 21. The desired roof pitch is set by rotating the channel members 137, 139 making up the header 11 relative to one another.

Thus, in accordance with the invention, a lean-to structure can be constructed with a roof having a selected pitch using standardized adjustable components. The angle at the ridge is set by adjusting the length of the arcuate flange 51 on the ridge bar 9 and the angle of the hinge assembly 63. The angle between the roof support bars and vertical support bars is set by rotating the pivot bracket 111 to the selected angle, and fixing that angle by drilling holes 133 and inserting set screws or roll pins 135. The pitch is set at the eaves by rotating the pivoted channel members 137, 139 making up the header 11 to the desired angle. This arrangement does away with the necessity of maintaining an inventory of components only suitable for one roof pitch.

The invention has been described as applied to a lean-to structure with a straight eave. That is, a structure in which the planar roof panels meet the wall panels at the pitch angle. In some installations, the plane of the roof curves into the plane of the wall. There is no header at the eave in these installations, and support bar sections curved to accommodate the curvature between the roof support bars and the wall support bars must be provided for each roof pitch. However, even in these installations, the ridge bar unit of the invention offers a single, adjustable assembly for selected roof pitches.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An assembly for supporting roof panels at selectable pitch angles comprising:

an elongated generally horizontally extending ridge bar forming a ridge support for the roof panels and having a generally vertically extending base portion, a ledge projecting laterally from and extending generally horizontally along said base portion, a generally horizontally extending arcuate flange projecting laterally outward and curving downward from the base portion and spaced above said ledge to form therewith a generally horizontal slot in which an upper edge of a roof panel is supported, generally horizontally extending end portions of said arcuate flange being selectively removable to select the angle of said slot and therefore the pitch angle at which said panel is supported; and a generally horizontally extending header forming an eave support for said panels and comprising a pair of generally U-shaped channels each having a web and two spaced generally horizontally extending flanges, one flange of each channel member being pivotally connected to the corresponding flange on the other channel member for rotation relative to each other about a common generally horizontal axis, the other flange on each channel member being curved in a vertical plane about said common generally horizontal axis such that said other flanges maintain an overlapping relation with one another as said channel members are rotated with respect to each other, one of said channel members being secured to the lower generally horizontal edge of the roof panel and the other being supported in a fixed position, such that through selection of the length of the arcuate flange on the ridge member and the relative angle of rotation of the channel members forming the header, roof panels may be supported at a selected pitch angle.

2. The assembly of claim 1 including at least two generally horizontally spaced roof support bars which engage and support side edges of the roof panels, and hinge brackets connected to the roof support bars and pivotally attached to the base portion of the ridge member for rotation about a generally horizontal axis substantially coincident with the center of curvature of said arcuate flange such that said roof support bars can be supported at the same selected pitch angle as the roof panels.

3. The assembly of claim 2 including at least two generally vertical support bars and pivoted support brackets for connecting said roof support bars to the generally vertical support bars at the selected roof pitch angle, said pivot support brackets comprising a pivot bar secured at one end to each support bar, each of said support bars having a boss extending from the other end along one side, said bosses defining transverse bores, a pivot pin extending through said transverse bores to rotatably connect said pivot bars and therefore said roof and generally vertical support bars, said pivot bars being rotatable about said pin to set the roof support bar at the selected roof pitch, and at least one elongated member secured in a hole drilled in one boss which elongated member interferes with and prevents relative rotation of the pivot bars relative to one another once the roof support bar has been set at the selected pitch angle.

4. The assembly of claim 1 wherein said ridge member and said channel members comprising said header are extruded, said one flange on one channel member being extruded to define a generally longitudinally extending external cylindrical surface and said one flange on the other channel member being extruded to define a groove with an internal cylindrical surface which mates with said external cylindrical surface on the one flange of the one channel member to effect the pivotal connection between said channel members.

5. The assembly of claim 4 wherein the curved other flange on said one extruded channel member secured to a lower edge of a roof panel is bifurcated to form a generally horizontally extending arcuate groove into which the curved other flange on the other channel member extends in overlapping relation with the bifurcated flange.

6. Apparatus for supporting the ends of roof panels at selectable pitch angles, comprising:

first and second elongated channel members each having a central web defining a longitudinal axis, and spaced, generally longitudinally extending flanges projecting laterally from one face of the web, means for pivotally connecting one flange on one said channel member to one flange on the other channel member for rotation of said channel members relative to one another about a generally longitudinally extending axis of rotation, the other flange on a first of said channel members terminating in an arcuate portion curved also about said generally longitudinally extending axis of rotation, the other flange on the second of said channel members terminating in an arcuate portion also curved about said generally longitudinally extending axis of rotation adjacent to, and rotatable in overlapping relation with, the arcuate portion on the other flange on said first channel member.

7. The apparatus of claim 6 wherein said means for pivotally connecting said channel members, comprises a bead on said one flange on one said channel member forming at least a partial cylindrical surface extending generally longitudinally along said one flange to define said generally longitudinally extending axis of rotation, and a rib on said one flange on the other channel member defining a generally longitudinally extending groove with an internal cylindrical surface which mates with, and is rotatable about the cylindrical surface on said one flange on the one channel member.

8. The apparatus of claim 6 wherein the arcuate portion of said other flange on the second channel member is bifurcated to define a generally longitudinally extending arcuate groove into which said arcuate portion of said other flange on the first channel member extends.

9. The apparatus of claim 8 wherein said arcuate groove is wider than the radial thickness of said arcuate portion of said other flange on the first channel member, and including a generally longitudinally extending, radially projecting, projection on the arcuate portion of said other flange on the first channel member which substantially fills the radial width of said arcuate groove.

10. The apparatus of claim 9 wherein said projection extends radially inward and outward from the terminal end of the arcuate portion of said other flange on the first channel member.

11. The apparatus of claim 7 wherein said rib on the one flange on said other channel member defines an internal cylindrical surface of more than 180 degrees such that said channel members are pivotally secured to one other for relative rotation about said generally longitudinally extending axis of rotation by the mating of said rib on said other channel member with said bead on said one channel member.

12. The apparatus of claim 11 wherein said first channel member is said one channel member and said second channel member is said other channel member.

13. The apparatus of claim 6 including thermal barrier material inside each channel member extending generally longitudinally along the channel member and across a generally longitudinally extending debridging slot milled in said web between said flanges.

14. The apparatus of claim 13 wherein said channel members are extruded with generally longitudinally extending, confronting lips projecting inward along said flanges to define a generally longitudinally extending slot in which cast in place thermal barrier material is secured.

15. A ridge bar unit for securing a roof including roof panels to a generally vertical support at selectable roof pitch angles, comprising:

an elongated ridge bar having a longitudinal axis and a generally planer base portion extending transversely to the longitudinal axis;

a generally longitudinally extending ledge projecting laterally from one face of the generally planer base portion and defining a lower, pivot support for the roof panels;

a generally longitudinally extending arcuate flange projecting from the one face of the base portion and spaced from said ledge, said arcuate flange terminating in a free end and being curved toward said ledge in a plane transverse to the longitudinal axis of the ridge bar to form a generally longitudinally extending slot in which said roof panel is received, said arcuate flange defining at least one generally longitudinally extending score line spaced from the free end of the flange along which said flange is frangible to selectively adjust the angle of said slot.

16. The ridge bar unit of claim 15 including a generally longitudinally extending locking strip which is inserted into said slot adjacent to the roof panel to secure the roof panel in said slot.

17. The ridge bar unit of claim 16 including a resilient generally longitudinally extending sealing strip secured on said ledge.

18. The ridge bar unit of claim 17 wherein said ledge defines a generally longitudinally extending undercut groove and said sealing strip is provided with a generally longitudinally extending undercut tongue which is received in the undercut groove to secure said sealing strip to said ledge.

19. The ridge bar unit of claim 15 in which said roof includes roof support bars, wherein said unit includes at least one hinged bracket secured to the one face of the base portion of the ridge bar with a hinge axis thereof coincident with the center of the radius of curvature of said arcuate flange, for supporting a roof support bar at a selected angle corresponding to the selected angle of said roof panel receiving slot.

20. The ridge bar unit of claim 19 wherein said hinged bracket comprises a body member and a cylindrical boss at one end of the body member, said cylindrical boss defining a cylindrical bore, said unit including a hinge pin extending through and rotatable in the cylindrical bore to define the hinge axis, and means for connecting the hinge pin to the base portion of the ridge bar.

21. The ridge bar unit of claim 20 wherein said ledge defines a generally longitudinal groove with a cylindral surface which rotatably receives said cylindrical boss of said hinged bracket.

22. The ridge bar unit of claim 16 including thermal barrier material extending across a generally longitudinally extending debridging slot milled in the base portion between said ledge and arcuate flange.

23. The ridge bar unit of claim 22 wherein said ridge bar is extruded with a pair of generally longitudinal flanges laterally projecting from said one face of the base portion between said ledge and arcuate flange with confronting lips on said flanges defining therewith an undercut groove in which said thermal barrier material is cast in place.

24. A pivot bracket for connecting a roof support bar to a generally vertical support bar at a selectable pitch angle, comprising a pivot bar secured at one end to each of said roof support bar and said generally vertical support bar, each of said pivot bars having a boss extending from the other end along one side, defining a transverse bore, a pivot pin passing through said bores to rotatably connect said pivot bars and therefore said roof support bar and generally vertical support bar, said pivot bars being rotatable about said pin to set the roof support at the selected pitch angle, and at least one elongated member secured in a hole drilled in one boss, which elongated member interferes with and prevents rotation of the pivot bars relative to one another once the roof support bar has been set at the selected pitch angle.

25. The pivot bracket of claim 24 wherein each boss defines a transverse groove and a hole is drilled in the other boss such that an elongated member secured in the hole engages said transverse groove to thereby prevent relative rotation of said pivot bars.

26. The pivot bracket of claim 25 wherein said roof support bar and generally vertical support bar are hollow extruded members and said pivot bars telescope inside the roof support bar and vertical support bar respectively, and including fasteners for securing said pivot bars in said support bars.

* * * * *

UNITED STATES PATENT AND TRADEMARK OFFICE

CERTIFICATE OF CORRECTION

PATENT NO. : 4,724,646

DATED : February 16, 1988

INVENTOR(S) : LEO J. MEYERS

It is certified that error appears in the above-identified patent and that said Letters Patent is hereby corrected as shown below:

Column 3, line 63, after "fingers" insert --59 on the sealing strip which engage the glass panels--.

Claim 21, column 10, line 6, "cylindral" should be --cylindrical--.

Signed and Sealed this

Eighteenth Day of October, 1988

*Attest:*

DONALD J. QUIGG

*Attesting Officer*

*Commissioner of Patents and Trademarks*